US006128923A

United States Patent [19]

Brams

[11] Patent Number: 6,128,923

[45] **Date of Patent: *Oct. 10, 2000**

[54] HOOP EARRING WITH A HIDDEN POST

[75] Inventor: Peter S. Brams, Guttenberg, N.J.

[73] Assignee: Melcor, Inc., Long Island City, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/176,139

[22] Filed: Oct. 21, 1998

[51] Int. Cl.[7] ..... A44C 7/00

[52] U.S. Cl. ..... 63/12

[58] Field of Search ..... 63/12, 13

[56] References Cited

U.S. PATENT DOCUMENTS

| | | | |
|---|---|---|---|
| 87,072 | 2/1869 | Rowland | 63/13 X |
| 271,121 | 1/1883 | Riley et al. | 63/12 |
| 785,857 | 3/1905 | Cassity | 63/13 X |
| 4,291,551 | 9/1981 | Levine | 63/12 |
| 5,816,073 | 10/1998 | Bardisbanyan | 63/12 |

FOREIGN PATENT DOCUMENTS

| | | | |
|---|---|---|---|
| 65910 | of 0000 | Australia | 63/12 |
| 2585220 | 1/1987 | France | 63/12 |

OTHER PUBLICATIONS

Advertisement from Kenyon Tool Incorporated appearing on p. 53 of the AJM Oct. 1997.

*Primary Examiner*—Terry Lee Melius
*Assistant Examiner*—Andrea Chop
*Attorney, Agent, or Firm*—Levisohn, Lerner, Berger & Langsam

[57] ABSTRACT

A hoop earring comprising a front portion and a back portion, where a post is attached to the front portion and a finding is hingedly connected to the back portion. When an earring is worn the finding is rotated about an axis of the hinge to cover the post. The front portion is designed in a way that allows it to be partially inserted inside an extended pierced hole, so that, when viewed from outside, such hole is not visible.

6 Claims, 2 Drawing Sheets

HOOP EARRING WITH A HIDDEN POST

FIELD OF THE INVENTION

The present invention relates to jewelry items. More specifically, the present invention relates to a hoop style earring with a post hidden by a finding behind an ear and without a joint connecting such post to the hoop at the front. Present invention also provides a tailored front portion of the hoop which is capable of being inserted into a pierced hole in an earlobe.

BACKGROUND OF THE INVENTION

Earrings are popular items of jewelry which have been worn by men and women for centuries. The most common and popular earring design has traditionally been the hoop design. The advantages of that design is that such hoop earring is very easy to put on and to take off. As shown in FIG. 1, however, such traditional hoops have a post connected to the front of the earring by a joint visible from the outside. Additionally, the post of a traditional hoop is sticking out on the back of an ear, which is not only aesthetically unattractive, but also presents a safety concern because the end of the post can damage the skin behind an ear and cause an infection. Another problem presented by the traditional hoop design is that such design opens to an outside view a pierced hole if such hole is extended after a long term earring wear.

Several solutions to the above enumerated problems have been presented over the years. An earring design, known in the industry as "leverbacks," is one of such attempts to solve the problems of traditional hoops. "Leverback" is constructed as a hook shaped wire 30 one end 32 of which is inserted into a pierced ear 34 and another end 38 is attached to a finding 36, which can cover the first end 32 of the wire 30 on the back of the ear 34. Thus, while solving the safety problem, the entire appearance of a leverback earring is presented by a wire/post 30, and that is precisely the problem which the present invention is designed to avoid. Different ornaments 40 can be attached to the bottom of the wire 30. As a result, as shown in FIG. 2, "leverback" design gives wearer a different visual appearance than the hoop design, moreover, such an earring extends a pierced hole even further.

Another possible solution is presented by the design known as "Huggies." As shown in FIGS. 3 and 4, "Huggies" are constructed as two half-hoops hingedly connected at the bottom. The post at the top is forced and secured into its place within the back half. The details of that connection are shown in FIG. 4. "Huggies" have to be made wide and small in diameter, so that the hinged connection would not be very obvious. Thus, the "Huggies" are not only more complicated in construction than regular hoops but they are also limited to wide petit shapes in its design. Moreover, because of its complicated construction, "Huggies" are relatively more expensive than traditional hoops.

Accordingly, there is an interest in the art for hoop earring construction which would provide comfort, versatility and aesthetical appearance of a traditional hoop, while hiding a post and preventing outside observers from seeing an extended pierced hole in an ear lobe.

SUMMARY OF THE INVENTION

It is an object of the present invention to provide a hoop earring design where the front and the back of its post is safely hidden from an outside viewer.

It is another object of the present invention to provide a hoop earring design where the front portion is adopted to hide an extended pierced hole in an earlobe of a wearer.

It is a further object of the present invention to provide a hoop earring with a hidden post of an inexpensive, simple and functional design.

The invention accomplishing the above enumerated objects is a hoop earring comprising a front portion and a back portion, where a post is attached to the front portion without a joint and a finding is hingedly connected to the back portion. When an earring is worn the finding is rotated about an axis of the hinge to cover the post. The front portion is designed in a way that allows it to be partially inserted inside an extended pierced hole, so that, when viewed from outside, such hole is not visible.

DETAILED DESCRIPTION OF THE PREFERRED EMBODIMENT AND THE DRAWINGS

Figure 1:
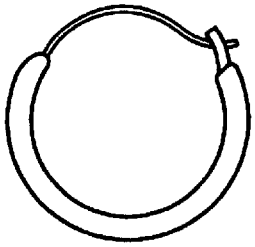
(PRIOR ART) FIG. 1
FIG. 1 shows a side view of a traditional hoop design.
Figure 2:
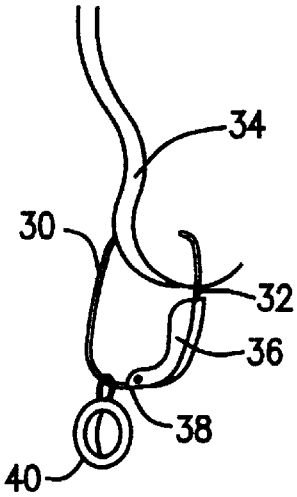
(PRIOR ART) FIG. 2
FIG. 2 shows a perspective back view of a "leverback" design.
Figure 3:
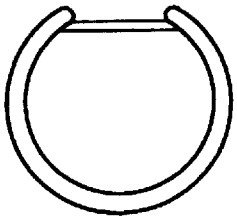
(PRIOR ART) FIG. 3
FIG. 3 shows a side view of a "Huggie" design.
Figure 4:
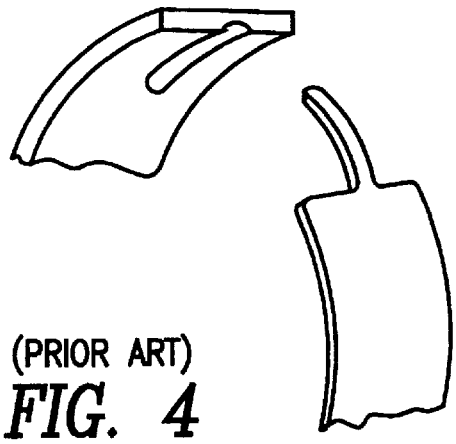
(PRIOR ART) FIG. 4
FIG. 4 is a perspective enlarged partial view of a "Huggie" design showing the details of post connection.

As best seen in the drawings, a hoop earring 10 is provided where its post 8 is safely hidden from an outside viewer and where the front portion 4 has no joint and is adopted to hide an extended pierced hole in an earlobe of a wearer. In the preferred embodiment, illustrated in FIGS. 5, 6 and 7, hoop earring 10 basically consists of a main hoop 2 which, in the preferred embodiment, is a solid gold C-shaped hoop of about 1" in diameter. This main hoop 2 has a front portion 4, which gradually thins into post 8, and a back portion 6 which has an extension 16 to which finding 12 is hingedly connected by hinge 14. Being described as solid, the main hoop 2 may also be made hollow and of any material used in the art.

Figure 8:
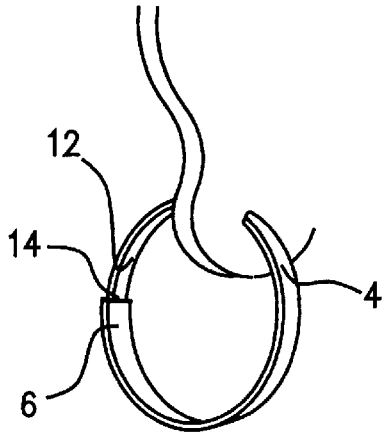
FIG. 8 is a perspective view of the present invention when the hoop earring is worn.

When the hoop earring is put on by a wearer, as shown in FIG. 8, the front portion 4 of the main hoop 2 is selectively inserted into a pierced hole following the post 8 until the hole is completely filled by the earring. Since the front portion 4 is polished to be smooth there can be no injury to an earlobe. Such design allows for a hole to be invisible from outside.

Post 8 is typically formed of a wire having a circular cross-section. Its length should slightly exceed thickness of an earlobe for which it is designed so that the finding 12 could cover the very end of post 8. In the preferred embodiment the length of the post is equal to the thickness of a human ear lobe plus 1–4 mm. Shown to be made of gold in the preferred embodiment, the post 8 can be made of any precious or non-precious metal. It is adopted to be selectively passed through the pierced hole in a person's earlobe in a conventional manner.

Figure 5:
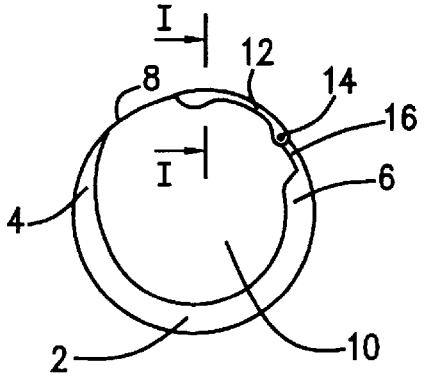
FIG. 5 shows a side view of the present invention when the hoop earring is closed.
Figure 6:
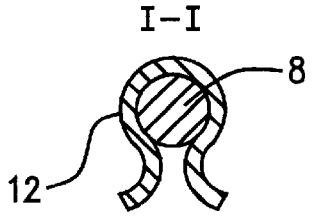
FIG. 6 is a cross-sectional enlarged view of the arrangement shown in FIG. 5, taken along the line I—I.
Figure 7:
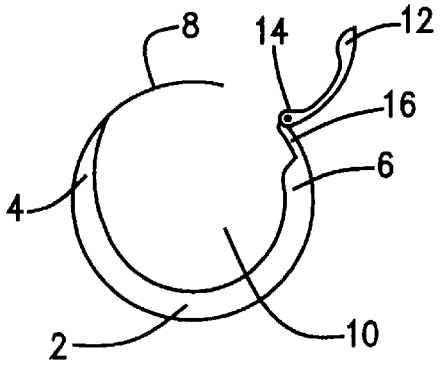
FIG. 7 shows a side view of the present invention when the hoop earring is open.

Finding 12 is pivotally mounted on the hinge 14 for rotation about an axis of the hinge 14. Hinge 14 can be attached either to an extension 16 of the back portion 6 or directly to the back portion 6 of the main hoop 2. Any finding known in the art can be used in combination with the present invention. The finding used in the preferred embodiment is a springless finding, disclosed in the U.S. Pat. No. 5,782,108, with a detent which is formed by striking inwardly portions of the opposing walls of the finder so as to form a narrowed throat or constriction, as shown in FIG. 6. The distance between these detent walls is less than the outer diameter of a post 8 such that the post must forcibly pass through the detent as the wearer opens or closes an earring. As shown in FIG. 6, the upper surface of the finding is concaved to partially embrace the post 8 behind an ear. In accordance with the preferred embodiment, the finding 12 pivots on hinge 14 such that the length of the finding extends along the length of post 8 (i.e. the longitudinal direction or axis of the finding 12 extends along the longitudinal direction or axis of the post 8) when the post is covered by the finding, as shown in FIGS. 5 and 7. Thus, the finding is preferably parallel to the post (and not perpendicular to the post) when the post is covered by the finding, as shown in FIG. 5. It is further preferred that the finding cover substantially the entire length of the post, as also shown in FIG. 5.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

I claim as follows:

1. A hoop earring comprising:

a main hoop having a front portion and a back portion;

a post connected to said front portion of said main hoop, said post having a length and a longitudinal axis; and a finding having a length and a longitudinal axis and two ends, one end thereof being hingedly movable and the other end of said finding having a narrowed throat, said narrowed throat having an open bottom, said one end of said finding being hingedly connected to said back portion of said main hoop, and said open bottom of said narrowed throat being capable of being attached onto and over said post, to secure said finding to said post by covering and frictionally holding said post behind an ear, said other end of said finding being spaced from said front portion of said main hoop, wherein said post is hidden from view and said longitudinal axis of said finding extends along said longitudinal axis of said post when said narrowed throat of said finding is attached onto and over said post.

2. A hoop earring according to claim 1, wherein said front portion of said main hoop is thinned at a point of connection with said post and is insertable into an extended pierced hole.

3. A hoop earring according to claim 2, further comprising a hinge mounted on said back portion of said main hoop, for hingedly connecting said finding to said back portion of said main hoop.

4. A hoop earring according to claim 3 wherein said finding is pivotally mounted on said hinge and is capable of being rotated about an axis of said hinge.

5. A hoop earring according to claim 2 wherein the length of said post is so dimensioned so as to be 1–4 mm greater than the thickness of the earlobe of a human.

6. A hoop earring as claimed in claim 1, wherein said finding covers substantially the entirety of said length of said post, when said finding covers said post.

* * * * *